United States Patent [19]

Iwasaki

[11] 4,016,377

[45] Apr. 5, 1977

[54] SLIDE SWITCH ASSEMBLY HAVING IMPROVED FIXED KNIFE BLADE TYPE CONTACT STRUCTURE

[75] Inventor: Sadayoshi Iwasaki, Furukawa, Japan

[73] Assignee: Alps Electric Co., Ltd., Tokyo, Japan

[22] Filed: May 19, 1975

[21] Appl. No.: 578,482

[30] Foreign Application Priority Data

May 21, 1974 Japan ..... 49-57630

[52] U.S. Cl. ..... 200/16 F; 200/16 D; 200/254; 200/275

[51] Int. Cl.[2] ..... H01H 15/04; H01H 1/42

[58] Field of Search ..... 200/16 D, 16 E, 16 F, 200/254, 275

[56] References Cited

UNITED STATES PATENTS

| | | | |
|---|---|---|---|
| 2,902,550 | 9/1959 | Allison | 200/16 F |
| 3,174,002 | 3/1965 | Golbeck | 200/16 D |
| 3,399,282 | 8/1968 | Nagashima et al. | 200/16 D X |
| 3,485,966 | 12/1969 | Bailey | 200/16 D |
| 3,502,825 | 3/1970 | Bailey et al. | 200/16 D |
| 3,624,320 | 11/1971 | Eberhart et al. | 200/16 D |
| 3,643,043 | 2/1972 | Endow | 200/16 F |
| 3,729,600 | 4/1973 | Solomon et al. | 200/16 D |
| 3,783,204 | 1/1974 | Kennedy et al. | 200/16 D X |
| 3,818,169 | 6/1974 | Kobernus | 200/16 D X |
| 3,843,852 | 10/1974 | Lockard | 200/16 D |
| 3,858,012 | 12/1974 | Lockard | 200/16 D |
| 3,896,276 | 7/1975 | Held | 200/16 D X |

*Primary Examiner*—James R. Scott
*Attorney, Agent, or Firm*—Guy W. Shoup

[57] ABSTRACT

Two integrally formed fixed contacts each have a lead portion with terminals at the opposite ends extending external of the switch housing and a contact portion connected to the lead portion by a connecting portion. A holder slidable in the housing retains a U-shaped movable contact which is movable to and from a position in which the opposed internal faces of the movable contact engage with the opposed external faces of the fixed contacts respectively to establish ohmic connection between the lead portions of the two fixed contacts.

17 Claims, 8 Drawing Figures

SLIDE SWITCH ASSEMBLY HAVING IMPROVED FIXED KNIFE BLADE TYPE CONTACT STRUCTURE

The present invention relates to a switch in which a movable contact engages with two opposed faces of fixed contacts.

In known switches such as sliding block switches, a movable contact is engagable with one face of a fixed contact. Problems are encountered in such switches in that the ohmic contact between the movable and fixed contacts is often unstable, resulting in fluctuating contact resistance. This is especially common in latching switches consisting of one or more sliding block switches ganged together. Proper engagement may be obtained when the switch is depressed and the relative movement between the movable contact and the fixed contact is slow, but such switches are provided with springs to return the movable contact at high speed when unlatched. The contacts tend to bounce which results in unstable operation. This drawback is especially critical in digital equipment where the bouncing contacts may produce pulses which cause erroneous operation of the equipment.

It is therefore an important object of the present invention to provide a switch in which a movable contact is arranged to ohmically contact two opposing external faces of a fixed contact.

It is another object of the present invention to provide a switch which is stable in engaging operation and contact resistance.

It is another object of the present invention to provide a switch comprising a fixed contact having terminal portions extending external of opposite surfaces of the switch housing.

The above and other objects, features and advantages of the present invention will become clear from the following detailed description taken with the accompanying drawings, in which.

Figure 1:
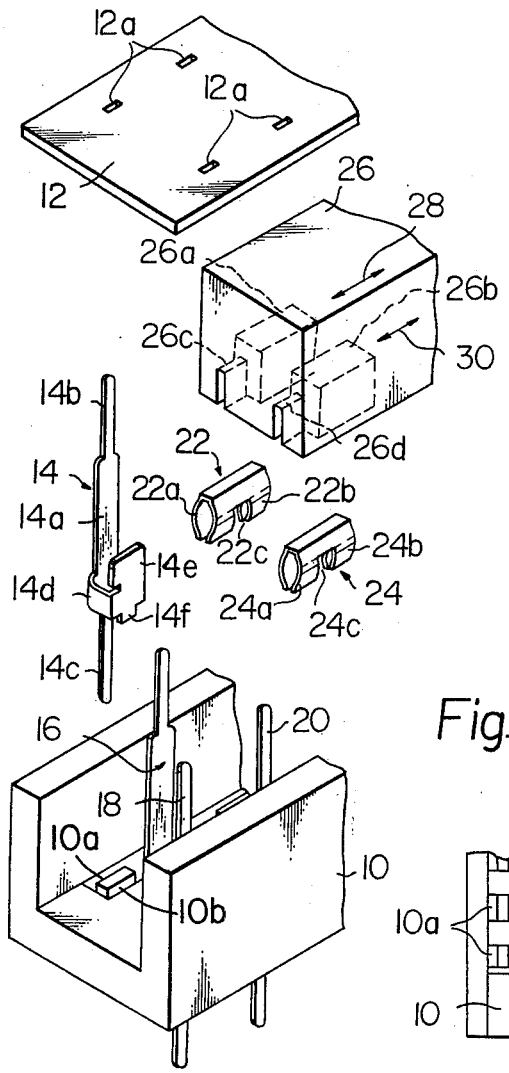
FIG. 1 is a fragmentary exploded view of a preferred embodiment of a switch according to the present invention.
Figure 3A:
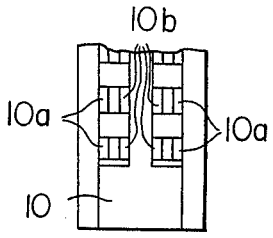
Figure 3B:
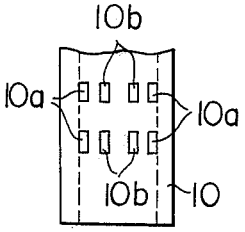
Figure 4A:
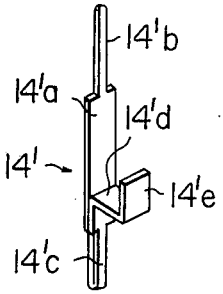
Figure 4B:
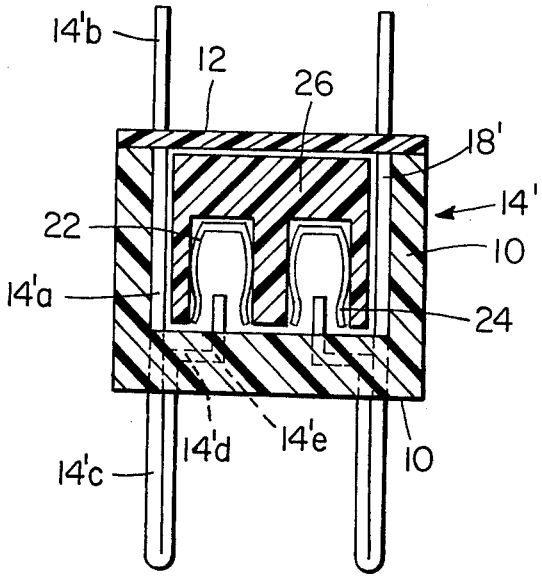
Figure 5A:
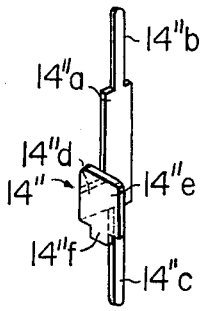

FIG. 3*a* is a fragmentary top view of the housing of the switch shown in FIG. 1;

FIG. 3*b* is a fragmentary bottom view of the housing shown in FIG. 3*a*;

FIG. 4*a* is a perspective view of a modified fixed contact of the switch shown in FIG. 1;

FIG. 4*b* is a sectional elevation of an embodiment of a switch utilizing the fixed contact shown in FIG. 4*a*;

FIG. 5*a* is similar to FIG 4*a* but shows another modified switch contact; and

Figure 5B:
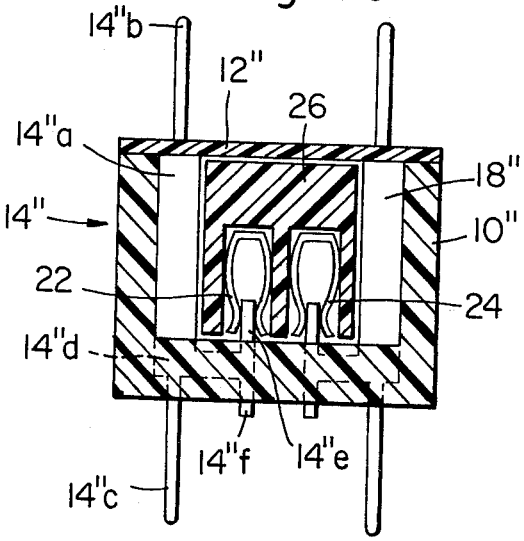

FIG. 5*b* is a sectional elevation of an embodiment of a switch utilizing the fixed contact shown in FIG. 5*a*.

Referring now to FIG. 1, a switch embodying the present invention comprises a housing 10 and cover 12 made of an insulating material such as plastic to be fitted together by means such as an adhesive. The switch further comprises four conductive sheet metal fixed contacts 14, 16, 18 and 20.

The fixed contact 14 is shown as being integrally formed with a flat lead portion 14*a*, the opposite ends of which constitute terminals 14*b* and 14*c*. A connecting portion 14*d* is formed at an intermediate point between the terminals 14*b* and 14*c* and bent perpendicular to the lead portion 14*a*. A flat contact portion 14*e* is bent perpendicular to the connecting portion 14*d* and parallel to the lead portion 14*a*, and is formed at its bottom edge with a retaining portion 14*f*. The fixed contacts 16, 18 and 20 are preferably identical to the fixed contact 14.

Movable conductive contacts 22 and 24 are arranged to engage with the contact portions of the fixed contacts 14 and 16 and the fixed contacts 18 and 20 respectively. The movable contacts 22 and 24 are generally U-shaped in profile and are formed with contact portions 22*a* and 24*a* and contact portions 22*b* and 24*b* separated by cutouts 22*c* and 24*c* respectively. If desired, the cutouts 22*c* and 24*c* may be omitted in which case the contact portions 22*a* and 22*b* and the contact portions 24*b* and 24*c* would be integral.

The switch is shown in the form of a sliding block switch having a sliding block or holder 26 which is slidable in the housing 10. The bottom surface of the holder 26 is formed with grooves 26*a* and 26*b* to retain the movable contacts 22 and 24 and slots 26*c* and 26*d* through which the contact portions of the fixed contacts 14 and 18 respectively may extend.

Figure 2:
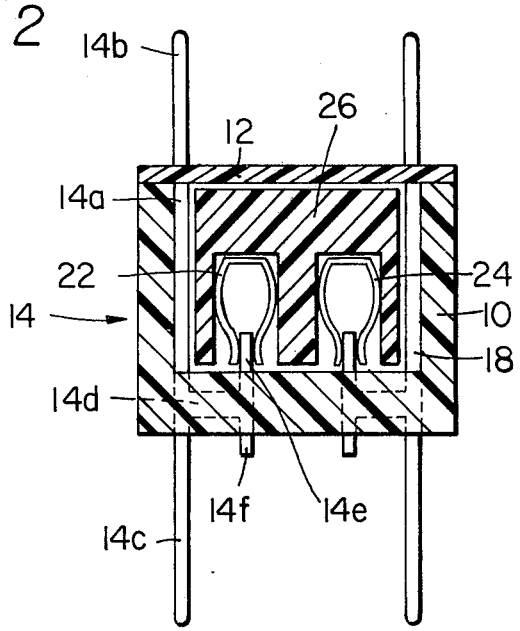
FIG. 2 is a sectional elevation of the switch shown in FIG. 1.

Referring also to FIGs. 3*a* and 3*d*, the bottom of the housing 10 is formed with four outer slots 10*a* and four inner slots 10*b*. The lower terminals of the fixed contacts 14, 16, 18 and 20 extend external of the housing 10 through the slots 10*a* respectively (only the terminal 14*c* is designated by a reference numeral). The retaining portions of the fixed contacts 14, 16, 18 and 20 extend into the slots 10*b* respectively (only the retaining portion 14*f* is designated by a reference numeral). The cover 12 is formed with slots 12*a* through which the upper terminals of the fixed contacts 14, 16, 18 and 20 extend external of the cover 12 respectively (only the terminal 14*b* is designated by a reference numeral). As shown in FIG. 2, the connecting portions of the fixed contacts 14, 16, 18 and 20 (only the connecting portion 14*d* is designated by a reference numeral) are disposed between the bottom surface of the holder 26 and the upper surface of the lower wall of the housing 10 and thereby closely retained in position vertically. Similarly, the lead portions of the fixed contacts 14 and 16 are retained horizontally between the left surface of the holder 26 and the inner surface of the left wall of the housing 10 (as viewed in FIG. 2) and the lead portions of the fixed contacts 18 and 20 are retained between the right surface of the holder 26 and the inner surface of the right wall of the housing 10 (only the lead portion 14*a* is designated by a reference numeral). If desired, the retaining portions of the fixed contacts 14, 16, 18 and 20 may extend through the slots 10*b* external of the housing 10 and be bent back to further positively retain the fixed contacts 14, 16, 18 and 20.

The holder 26 is movable in a linear path so that the contact portions of the fixed contacts 14 and 16 and the inner surfaces of the contact portions 22*a* and 22*b* of the movable contact 22 are aligned along a path designated by an arrow 28. Similarly, the contact portions of the fixed contacts 18 and 20 and the contact portions 24*a* and 24*b* of the movable contact 24 lie along a path designated by an arrow 30. The spacing between the contact portions of the fixed contacts 14 and 16 along the path 28 is equal to the spacing between the contact portions 22*a* and 22*b* of the movable contact 22 and the spacing between the contact portions of the fixed contacts 18 and 20 along the path 30 is equal to the spacing between the contact portions 24*a* and 24*b* of the movable contact 24. The movable contacts 22 and 24 are preferably identical, but the spacing between the contact portions thereof may be different to provide a switch having more than two positions.

The switch may be provided with a knob or the like to move the holder 26, a return spring and other elements which are known in the art but not shown since they do not relate to the present invention.

In operation, the holder 26 is movable to and from a position in which the contact portions 22*a* and 22*b* of the movable contact 22 ohmically engage with the contact portions of the fixed contacts 14 and 16 respectively and the contact portions 24*a* and 24*b* of the movable contact 24 engage with the contact portions of the fixed contacts 18 and 20 respectively. When in said position, ohmic connection is made between the terminals of the fixed contacts 14 and 16 through the movable contact 22 and between the terminals of the fixed contacts 18 and 20 through the movable contact 24. When moved away from said position, the connection is broken.

In accordance with an important feature of the present invention, both opposed internal surfaces of the contact portions of the movable contacts 22 and 24 engage with the respective opposed external surfaces of the contact portions of the fixed contacts 14, 16, 18 and 20 respectively. This is in contrast to prior art switches in which only one surface of a movable contact engages with only one surface of a fixed contact. The novel concept of the present invention thereby provides switch with superior engaging and disengaging performance and stable contact resistance and overcomes the drawbacks of the prior art. The switch shown in FIG. 1 is exemplary only, and many modifications are possible. Rather than four fixed contacts associated with two movable contacts, the switch may comprise only two fixed contacts associated with one movable contact. The switch may comprise more than four fixed contacts and two movable contacts in any operable combination. The path of movement of the movable contacts does not have to be linear, and the scope of the present invention is also applicable to a rotary switch.

One of many possible modifications to the switch shown in FIG. 1 is illustrated in FIGS. 4*a* and 4*b*, which is identical except for the configuration of the fixed contacts. The fixed contact 14' is shown in FIG. 4*a* as being formed with a similar lead portion 14'*a* and terminal 14'*b*. In this case, however, the terminal 14'*c* is formed of two sections which are folded on each other (not designated by reference numerals). The end of one of the sections is connected to the connecting portion 14'*d*, which in this case is disposed horizontally rather than vertically. The contact portion 14'*e* is bent perpendicular to the connecting portion 14'*d*. In this case a retaining portion is not provided, although a retaining portion may be provided by bending the connecting portion 14'*d* or the contact portion 14'*c*. The slots 10*b* in the housing 10 may be omitted if the retaining portions are not provided.

Another switch may be embodied utilizing fixed contacts in which the contact portions are perpendicular to the lead portions. Such a switch is shown in FIG. 5*b* and the fixed contact 14'' is shown in FIG. 5*a*. The lead portion 14''*a*, terminals 14''*b* and 14''*c*, contact portion 14''*e* and retaining portion 14''*f* are identical to those shown in FIG. 1. The connecting portion 14''*d*, however, is not bent perpendicular to the lead portion 14''*a*. The housing 10'' is wider than the housing 10 and the slots (not visible in the drawings) corresponding to the slots 10*a* are formed perpendicular to the path of movement of the holder 26 rather than parallel thereto as shown in FIG. 3*a*. The slots (not shown) in the cover 12'' are also perpendicular to the path of the holder 26.

Numerous other modifications within the scope of the present invention will be immediately obvious to one skilled in the art.

What is claimed is:

1. A switch comprising a housing;

a holder slideably supported in the housing;

a movable contact set into the slideable holder and movable along a predetermined path, said movable contact having a contact portion of two opposed internal surfaces;

two fixed contacts fixed in place by the housing, each fixed contact having a contact portion of two opposed external contact surfaces and a lead portion connected to the contact portion as well as to two terminals which extend beyond the housing in opposite directions, the contact portions of the two fixed contacts being aligned with and spaced along the predetermined path;

whereby said movable contact is movable along the predetermined path, from a position in which the two opposed internal contact surfaces of the movable contact ohmically engage the external contact surfaces of the two fixed contacts, creating a conducting path between the fixed contacts, to a position in which the fixed contacts are disconnected.

2. The switch of claim 1, in which the movable contact has a generally U-shaped profile.

3. The switch of claim 1, in which each of the fixed contacts is formed with a connecting portion connecting the lead portion to the contact portion, said connecting portion means situating the contact portion of the fixed contact in line with the predetermined path of the movable contact.

4. The switch of claim 1, in which the lead and contact portions of the fixed contacts are flat.

5. The switch of claim 4, in which the contact portion of each fixed contact is perpendicular to the lead portion thereof.

6. The switch of claim 4, in which the contact portion of each fixed contact is parallel to the lead portion thereof.

7. The switch of claim 1, in which the lead and contact portions of each fixed contact are integral.

8. The switch of claim 3, in which the lead, contact and connecting portions of each fixed contact are integral.

9. The switch of claim 3, in which the connecting portion of each fixed contact is parallel to the lead portion thereof.

10. The switch of claim 3, in which the connecting portion of each fixed contact is perpendicular to the lead portion thereof.

11. The switch of claim 3, in which the contact portion of each fixed contact is perpendicular to the connecting portion thereof.

12. The switch of claim 1, in which the contact portion of each fixed contact is connected to the lead portion at an intermediate point between the terminals thereof.

13. The switch of claim 1, in which the contact portion of each fixed contact is formed with a retaining portion which extends into an opening formed in the housing.

14. The switch of claim 1, in which the holder is formed with a depression for retaining the movable contact.

15. The switch of claim 1, in which each fixed contact is formed with a connecting portion connecting the lead portion to the contact portion, and in which the lead portion of each fixed contact is closely disposed between adjacent internal and external surfaces of the housing and holder respectively and the connecting portion of each fixed contact is closely disposed between other internal and external surfaces of the housing and holder respectively.

16. The switch of claim 3, in which the lead portion of each fixed contact is formed of two sections folded on each other, the end of one section being connected to the connecting portion.

17. The switch of claim 1, in which the path is linear.

* * * * *